US008555664B2

(12) United States Patent
Ihle et al.

(10) Patent No.: US 8,555,664 B2
(45) Date of Patent: Oct. 15, 2013

(54) CONDENSER/COMPRESSOR FAN CONTROL FOR REFRIGERATOR

(75) Inventors: Hans Ihle, Giengen (DE); Matthias Mrzyglod, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1079 days.

(21) Appl. No.: 12/526,642

(22) PCT Filed: Feb. 25, 2008

(86) PCT No.: PCT/EP2008/052229

§ 371 (c)(1),
(2), (4) Date: Aug. 11, 2009

(87) PCT Pub. No.: WO2008/107328

PCT Pub. Date: Sep. 12, 2008

(65) Prior Publication Data

US 2010/0018230 A1 Jan. 28, 2010

(30) Foreign Application Priority Data

Mar. 7, 2007 (DE) ..... 10 2007 011 114

(51) Int. Cl.
*F25B 39/04* (2006.01)

(52) U.S. Cl.
USPC ..... 62/183; 62/234; 62/428; 62/508; 62/150; 62/151; 62/155; 62/156

(58) Field of Classification Search
USPC ..... 62/234, 183, 428, 508, 150, 151, 155, 62/156
See application file for complete search history.

(56) References Cited

U.S. PATENT DOCUMENTS

| | | | | |
|---|---|---|---|---|
| 4,156,352 | A * | 5/1979 | Gelbard et al. | 62/285 |
| 5,918,474 | A * | 7/1999 | Khanpara et al. | 62/179 |
| 7,437,885 | B2 * | 10/2008 | Wu et al. | 62/344 |
| 2003/0182951 | A1 | 10/2003 | Rafalovich et al. | |
| 2005/0086955 | A1 * | 4/2005 | Rafalovich et al. | 62/156 |
| 2005/0172665 | A1 * | 8/2005 | Kim et al. | 62/525 |
| 2006/0177318 | A1 * | 8/2006 | Santa Ana | 417/199.1 |
| 2007/0039339 | A1 | 2/2007 | Lee | |

FOREIGN PATENT DOCUMENTS

| | | | |
|---|---|---|---|
| DE | 29620350 | U1 | 3/1998 |
| DE | 10053422 | A1 | 5/2002 |
| DE | 102004058198 | A1 | 6/2006 |
| JP | 2000220944 | A | 8/2000 |
| RU | 58205 | U1 | 11/2006 |
| WO | 2004015342 | A1 | 2/2004 |

OTHER PUBLICATIONS

Decision on Granting a Patent for Invention RU 2009133102.

* cited by examiner

*Primary Examiner* — Marc Norman
*Assistant Examiner* — Jonathan Bradford
(74) *Attorney, Agent, or Firm* — James E. Howard; Andre Pallapies

(57) ABSTRACT

A refrigerator is provided that includes a chilled interior and a cooling circuit for a coolant, the cooling circuit being provided with an evaporator, a compressor, and a condenser. The refrigerator further includes a controller as well as a fan for cooling the condenser and the compressor. The controller controls the fan to operate during an idle phase of the compressor.

6 Claims, 1 Drawing Sheet

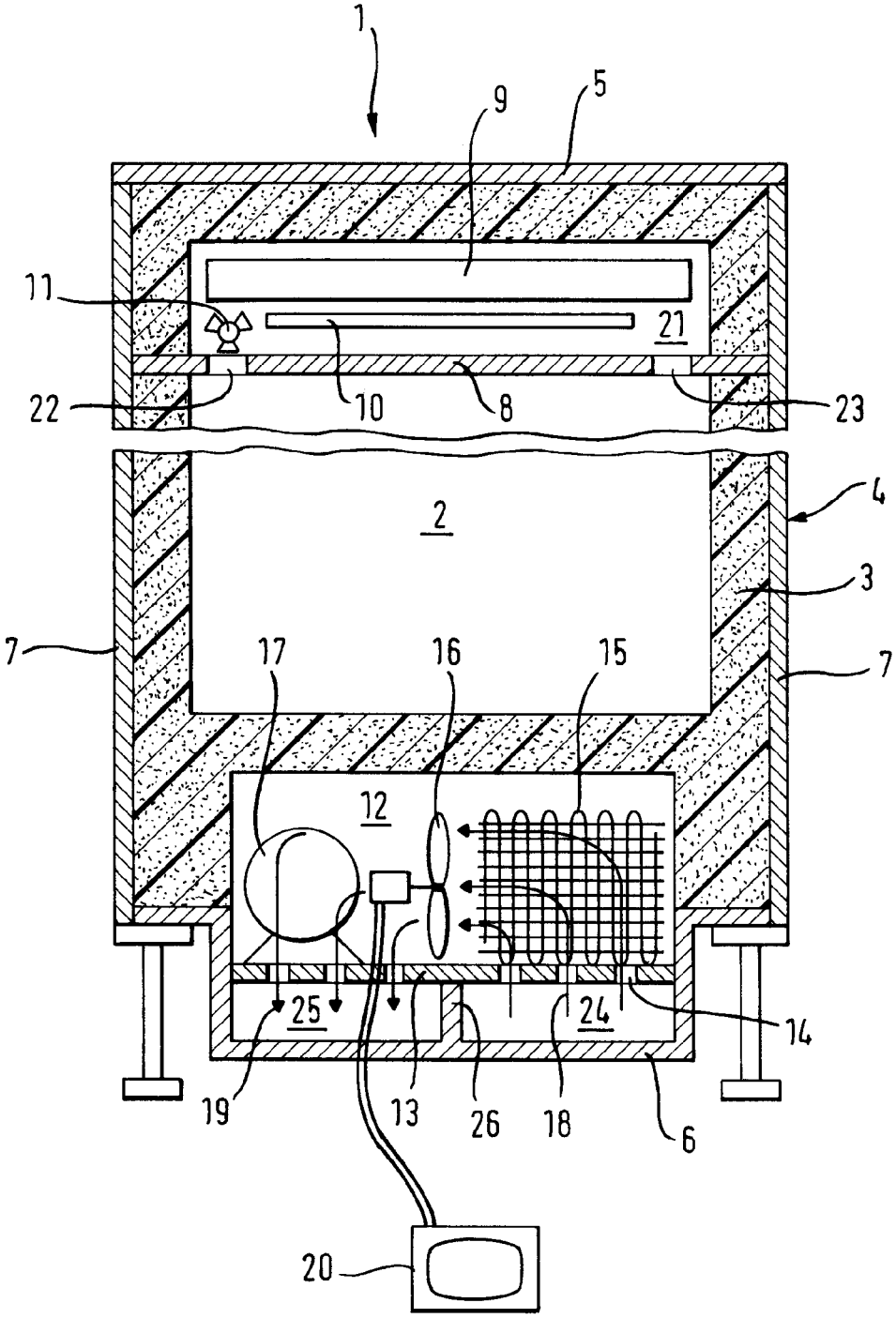
1
9
5
11
21
22
10
8
23
2
4
3
7
17
16
15
7
12
25
24
14
19
13
26
18
6
20

CONDENSER/COMPRESSOR FAN CONTROL FOR REFRIGERATOR

BACKGROUND OF THE INVENTION

The invention relates to a refrigerator.

In order to cool the interior of a refrigerator, a refrigeration circuit is generally provided in which a refrigerant circulates. Said refrigerant expands in the evaporator mounted in the interior, absorbing heat from the interior. Opening the door causes more or less moist air to enter the cooled interior. During operation, this moisture is first precipitated in the form of frost on the evaporator, then gradually turning into ice. In freezers, the wall temperature is also less than 0° C., so that in the course of time the walls also become coated with a layer of ice. As particularly a thick layer of ice on the evaporator has a negative effect on the transfer of heat from the air in the interior to the coolant in the evaporator, the compressor must be operated for a very long time in order to cool down the interior accordingly. The layer of ice on the evaporator must therefore be removed by defrosting.

Earlier refrigerators had to be manually defrosted by switching them off and opening the doors. The ice layer was allowed to melt and run down into a special container or was removed from the interior after it had become detached from the evaporator or the walls due to the heat introduced. Such defrosting was always a tedious process, as the refrigerated items could not remain in the refrigerator for the defrosting period, which might take several hours, but had to be stored elsewhere. However, it is only by regularly removing the evaporator's coating of ice that low power consumption and therefore efficient refrigeration can be ensured.

Modern refrigerators and freezers generally have automatic defrosting whereby the ice which has formed on the evaporator, reducing its cooling efficiency, is liquefied in order to allow it to run down into a special container. Evaporators of refrigerators of this kind are equipped with a heater which is operated under predefined conditions and raises the temperature of the evaporator to above freezing point. DE 100 53 422 A1 describes automatic defrosting which finds an economically desirable time for the defrosting process on the basis of measuring various parameters.

In order to prevent the refrigerated or frozen items from warming up during the defrosting process, in appliances with automatic defrosting the evaporator is usually accommodated in a compartment sealed off from the refrigerated interior. During the normal cooling phases, an exchange of air between the interior and the evaporator compartment takes place by means of an air circulation system. Said compartment is generally embodied at the back of the refrigerator, sloping down toward one side. The air moisture deposited as ice on the evaporator is thawed automatically or as required and the resulting liquid flows together down the slope to a point in the compartment from where it is fed through the rear wall into a collecting tray located in the machine compartment. There the liquid is evaporated by the waste heat of the compressor. During the defrosting process, the exchange of air between the interior and the evaporator compartment, which feeds the air to be cooled to the evaporator, is interrupted. This means that none of the air heated by the heater is fed to the cooled interior. The defrosting process therefore has no adverse effect on the refrigerated items.

On the outside of the refrigerator, the refrigeration circuit has a condenser which releases the heat absorbed by the refrigerant in the interior to the ambient air. In order to be able to ensure the necessary heat exchange, the condenser must be of a particular size which, particularly in the case of built-in appliances, is at the expense of the size of the refrigerated interior.

If the external dimensions of the refrigerator are retained, enlarging the refrigerated interior involves reducing the size of the condenser. In turn, the condenser now requires a blower capable of removing the heat produced by the condenser. The blower is generally positioned such that it simultaneously also force-ventilates the compressor. Such a design is described in DE 10 2004 058 198 A1. Such blowers are typically operated in parallel with the compressor.

In order to make refrigerators as energy efficient as possible, electrical loads such as compressors or blowers are installed which are designed to provide precisely the required performance and are not overspecified in any way. These electrical loads are therefore of very compact design and require little power.

When the refrigerated interior has reached its preset temperature, operation of the compressor and therefore also of the blower is interrupted and the evaporator absorbs no more heat from the interior of the refrigerator. However, the condenser heats up more strongly when the compressor is not working. This is due to the fact that the pressurized gas is liquefied even after the compressor has shut down, thereby releasing heat. However, this heat is no longer dissipated by the blower. The compressor also continues to give off heat which is likewise no longer eliminated by the blower and additionally heats up the condenser. This can result in the condenser no longer achieving the desired effect and only gaseous refrigerant being present throughout the refrigeration circuit.

When the temperature in the interior has reached a particular level because of the heat introduced due to the insulation or opening of the refrigerator door, the compressor starts up again. For cold generation in the evaporator, liquid refrigerant which can be expanded in the evaporator to the gaseous state is required in the condenser. However, if only gaseous refrigerant is now present in the condenser when the compressor restarts, no cold is initially generated in the evaporator despite the compressor being activated. The cooling capacity of the evaporator is not restored until the blower has cooled the condenser down to a particular temperature and the compressor has been running until correspondingly compressed refrigerant can be liquefied in the condenser.

However, it has been found that, after startup of the compressor, a considerable period of time may elapse until expandable liquid refrigerant is again present in the condenser. This period of time is significantly longer than a normal compressor phase. If a compressor is now designed only for the normal operating time, the compressor will be overloaded by the excessively long operating time, thereby becoming overheated. This overheating may result in activation of the motor protection provided for the compressor, thereby de-energizing the compressor. The compressor will not start up again until its temperature has fallen below a particular level. As this means that no cold refrigerant is fed to the evaporator for a lengthy period and therefore no heat is removed from the interior of the refrigerator, the refrigerated or frozen items stored therein may be damaged.

BRIEF SUMMARY OF THE INVENTION

The object of the invention is to design a refrigerator such that, after an idle phase of the compressor, cold can be produced more rapidly again by the evaporator and heat can be removed from the interior. This object is achieved according to the invention by a refrigerator. A control unit is inventively used which is designed such that the blower is activated during an idle phase of the compressor. Therefore, it is now possible to dissipate heat even during the idle phases of the compressor and to keep the condenser at a temperature at which liquid refrigerant is present in the condenser when the compressor starts up again. This significantly reduces the period of time for which, although the compressor is being operated, no cooling is yet being provided by the evaporator. It also reduces the total operating time of the compressor in a compressor phase. In addition, the compressor has been cooled down during the idle phase by the blower and can thus be operated at a lower temperature when it restarts. In this way, overloading of the compressor and activation of the motor protection can only occur in rare exceptional cases.

The inventive design is particularly advantageous if the break in operation is used for defrosting. Without activation of the blower, when the compressor restarts the refrigerant gas present at the compressor would have an even higher temperature than after a normal break due to the heating of the evaporator. After a defrosting operation, the time until refrigerant liquefies in the condenser would consequently last even longer than after a normal break. However, if the blower is operated during the defrosting phase, the condenser and compressor will be at a lower temperature level when the compressor restarts and liquefaction will take only a short time, thereby increasing the efficiency of the compressor and therefore of the entire refrigeration cycle. This means that the appliance retains a low power consumption.

In a possible variant of the invention, the blower is operated on time-controlled basis, it being assumed that approximately the same amount of heat is to be dissipated in each idle phase. The time is calculated such that in each case the temperature is reduced to the extent that liquid refrigerant is present in the condenser when the compressor restarts.

In order to save more energy and better match the blower operating time to the amount of heat to be dissipated, the blower is advantageously operated in a temperature-controlled manner during defrosting. For example, the blower is operated until such time as a predetermined temperature reduction has been achieved.

Particularly advantageously, however, the blower is operated until a predetermined temperature has been achieved at the condenser and/or compressor. This means that the blower is only operated until the condenser and if possible also the compressor have cooled down to a predetermined temperature. For example, the temperature of the machine compartment could be used for controlling the blower.

Particularly advantageously, the predetermined temperature is the ambient temperature. Further cooling down of the condenser to below the ambient temperature would only be possible by means of an additional refrigeration circuit. However, this would not make economic sense.

In another exemplary embodiment, the blower is operated throughout the defrosting process. This means that no temperature measuring is necessary and therefore no temperature sensor is required. The power requirement is slightly higher than in the previous example, as here the blower continues to operate even when the condenser has already attained ambient temperature. On the other hand, manufacturing costs can be saved in respect of control and temperature measurement.

BRIEF DESCRIPTION OF THE DRAWINGS

FIG. 1 shows a schematic cross section through a refrigerator according to the invention.

DETAILED DESCRIPTION OF EXEMPLARY EMBODIMENTS OF THE PRESENT INVENTION

In the section through a refrigerator 1 shown in FIG. 1, the front section with the door has been omitted and the view is onto the rear section of the refrigerator 1. The refrigerated interior 2 is surrounded by insulation 3. The insulation 3 is surrounded by an outer shell 4 which has a top 5, a base 6 and two side walls 7. The upper area of the interior 2 is divided by a false ceiling 8 above which an evaporator compartment 21 is located. Disposed in the evaporator compartment 21 are an evaporator 9, a heater 10 and a fan 11. The false ceiling 8 also has an inlet opening 22 and an outlet opening 23.

Located in the lower part of the refrigerator 1 is a cuboidal machine compartment 12. The machine compartment 12 is delimited laterally and to the top by the insulation 3 and to the base by the false floor 13. The false floor 13 runs parallel to and a short distance from the base 6 and is provided with openings 14 through which the air can circulate. The false floor 13 forms in conjunction with the intermediate bridge 26 and the base 6 an air inlet duct 24 and an air outlet duct 25. A condenser 15, a blower 16 and a compressor 17 are fixedly mounted to the false floor 13. The arrows 18 indicate air circulation, the air circulating in the direction of the arrow head 19. The refrigerator 1 also has a control unit 20 shown schematically here.

For reasons of clarity, the connection of the evaporator 9 to the condenser 15 is not shown. Also not shown is the collecting tray for defrost melt water in the machine compartment 12, the slope of the evaporator compartment 21 which channels the defrost melt water to an opening through which it is fed to the collecting tray, and the associated connecting tubes.

In order to cool the interior 2 to a preset temperature, air is drawn in from the interior 2 through the inlet opening 22 of the false ceiling 8 by means of the fan 11. This air is fed via the evaporator 9 through which the refrigerant flows, is cooled down in the process with the release of moisture and is fed back into the interior 2 via the outlet opening 23. This moisture is first deposited as frost on the evaporator 9 and gradually forms an ice layer. The gaseous heated refrigerant flows into the compressor 17 which compresses the refrigerant, thereby heating it further, and then into the condenser 15 where the refrigerant changes its state of aggregation from gaseous to liquid with the release of heat.

The heat in the machine compartment 12, produced partly by the condenser 15 and partly by the motor of the compressor 17, is dissipated by the blower 16. For this purpose the cool ambient air is sucked in through the openings 14 of the air inlet duct 24 and passes over the condenser 15, absorbing heat. This air is then fed via the compressor 17 where it again absorbs heat and is then discharged into the air outlet duct 25 via the openings 14 and returned to the environment via the air outlet duct 25 itself.

When the interior 2 has reached its preset temperature, the compressor 17 and fan 11 are switched off, causing no more cold to be produced.

A layer of ice on the evaporator 9 impairs heat transfer between the air to be cooled from the interior 2 and the refrigerant. This means that the compressor 17 must operate for longer to ensure that a preset temperature is attained in the interior 2, and as a result requires more power. For this reason, the evaporator 9 is defrosted either at regular intervals or at a point in time that makes economic sense. To this end, the evaporator 9 is heated by means of the heater 10. The defrost melt water is fed to the collecting tray in the machine compartment 12. The compressor 17 is switched off for the defrosting process.

However, according to the invention the blower 16 is also operated when the compressor 17 is switched off. In the exemplary embodiment shown here, the control unit 20 measures the temperature present at the condenser 15 and operates the blower 16 until such time as the condenser 15 has reached ambient temperature.

It is also possible, however, to dispense with measuring the temperature present at the condenser 15. The blower 16 then operates throughout the idle time of the compressor 17. This means that the blower 16 is also still operated when the condenser 15 has already assumed ambient temperature. For this reason the power consumption is slightly higher.

As the compressor 17 starts up at ambient temperature, refrigerant is immediately liquefied in the condenser 15. The operating time of the compressor 17 until attainment of the preset temperature in the interior 2 therefore moves within the normal range and no overheating of the compressor 17 occurs, thereby increasing the service life of the compressor 17. Any activation of the motor protection is also eliminated. The energy consumption of the refrigerator is reduced due to the short operating times of the compressor 17 even though the blower 16 is operated for longer.

The inventive control of the blower is particularly effective for carrying out defrosting. After the defrosting process, the refrigerant drawn in by the compressor 17 from the evaporator 9 is warmer than after a normal idle phase of the compressor 17, as additional heat has been introduced to the refrigerant by the heater 10. Liquefaction can consequently only take place when the refrigerant in the condenser 15 is cooled down correspondingly. Activation of the blower 16 during the defrosting process guarantees that, when the compressor 17 restarts, the condenser has a temperature which ensures operation of the condenser 15 virtually immediately. Therefore, when defrosting is complete, cold is also produced very quickly again by the evaporator 9 and the refrigerated items cannot warm up to a critical temperature.

LIST OF REFERENCE CHARACTERS

1 refrigerator
2 interior
3 insulation
4 outer shell
5 top
6 base
7 side wall
8 false ceiling
9 evaporator
10 heater
11 fan
12 machine compartment
13 false floor
14 opening
15 condenser
16 blower
17 compressor
18 arrow
19 arrow head
20 control unit
21 evaporator compartment
22 inlet opening
23 outlet opening
24 air inlet duct
25 air outlet duct
intermediate bridge

The invention claimed is:

1. A refrigerator comprising:
a refrigerated interior;
a refrigeration circuit for a refrigerant, the refrigeration circuit including an evaporator, a heater cooperable with the evaporator for a defrosting step, a compressor, and a condenser, the compressor operating in a compressing phase in which the compressor compresses the refrigerant and an idle phase in which the compressor does not compress the refrigerant;
a blower for cooling at least one of the condenser and the compressor;
a temperature sensor positioned to detect a temperature of the condenser and the compressor; and
a control unit, the control unit controlling the blower to operate during an idle phase of the compressor,
wherein the control unit performs the defrosting step during the idle phase of the compressor, and wherein the blower is operated in a temperature controlled manner with the heater ON during the defrosting step such that the blower is operated during the defrosting step until a predetermined temperature is attained at the condenser and the compressor as detected by the temperature sensor.

2. The refrigerator as claimed in claim 1, wherein the predetermined temperature is the ambient temperature.

3. A refrigerator comprising:
a refrigerated interior;
a refrigeration circuit for a refrigerant, the refrigeration circuit including an evaporator, a compressor, and a condenser, the compressor operating in a compressing phase in which the compressor compresses the refrigerant and an idle phase in which the compressor does not compress the refrigerant;
a blower for cooling the condenser and the compressor;
a temperature sensor positioned to detect a temperature of the condenser and the compressor; and
a control unit, the control unit controlling the blower to operate during an idle phase of the compressor, wherein the control unit is programmed to control the blower to operate until a predetermined temperature is attained at the condenser and the compressor as detected by the temperature sensor.

4. The refrigerator as claimed in claim 3, wherein the control unit is programmed to perform a defrosting step during the idle phase of the compressor.

5. A method of operating a refrigerator including a refrigeration compartment and a refrigeration circuit with an evaporator, a compressor and a condenser, the method comprising:
flowing refrigerant through the evaporator and drawing airflow across the evaporator to cool the airflow, wherein a temperature of the refrigerant increases after a heat exchange with the airflow;
flowing the refrigerant to the compressor and compressing the refrigerant in the compressor;
flowing the refrigerant to the condenser where the refrigerant changes from gaseous to liquid by releasing heat;
cooling the compressor and the condenser with a blower using ambient air;
switching off the compressor when a temperature in the refrigeration compartment reaches a desired temperature; and
operating the blower with the compressor switched off and maintaining liquid refrigerant in the condenser, wherein the operating step is practiced by measuring a temperature of the condenser and the compressor and by operating the blower with the compressor switched off until a predetermined temperature is reached at the condenser and the compressor.

6. The method according to claim 5, where the predetermined temperature is ambient temperature.

* * * * *

UNITED STATES PATENT AND TRADEMARK OFFICE

CERTIFICATE OF CORRECTION

PATENT NO. : 8,555,664 B2
APPLICATION NO. : 12/526642
DATED : October 15, 2013
INVENTOR(S) : Ihle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1080 days.

Signed and Sealed this
Fifteenth Day of September, 2015

Michelle K. Lee

Michelle K. Lee
*Director of the United States Patent and Trademark Office*